US010449571B2

(12) United States Patent
Steinfurth

(10) Patent No.: US 10,449,571 B2
(45) Date of Patent: Oct. 22, 2019

(54) SCREENING MACHINE

(71) Applicant: ALLGAIER WERKE GmbH, Uhingen (DE)

(72) Inventor: Holger Steinfurth, Moorrege (DE)

(73) Assignee: ALLGAIER WERKE GmbH, Uhingen (DE)

( * ) Notice: Subject to any disclaimer, the term of this patent is extended or adjusted under 35 U.S.C. 154(b) by 0 days.

(21) Appl. No.: 15/886,747

(22) Filed: Feb. 1, 2018

(65) Prior Publication Data

US 2019/0126322 A1 May 2, 2019

(30) Foreign Application Priority Data

Oct. 30, 2017 (DE) ..... 20 2017 005 675 U

(51) Int. Cl.
*B07B 13/16* (2006.01)

(52) U.S. Cl.
CPC ..... *B07B 13/16* (2013.01); *B07B 2201/04* (2013.01)

(58) Field of Classification Search
CPC ..... B07B 13/16; B07B 2201/04
USPC ..... 209/255, 259
See application file for complete search history.

(56) References Cited

U.S. PATENT DOCUMENTS 5,626,508 A * 5/1997 Rankin ..... B24C 5/04 451/102
6,024,227 A * 2/2000 Bilodeau ..... B03B 5/62 162/246
2018/0104719 A1* 4/2018 Colgrove ..... B07B 1/36

* cited by examiner

*Primary Examiner* — Terrell H Matthews
(74) *Attorney, Agent, or Firm* — Knobbe Martens Olson & Bear LLP

(57) ABSTRACT

A screening machine including at least one solid matter outlet with a circular or round connection device. The solid matter outlet can include a number of shaped cross-sections including a polygonal cross-section at least on the inside surface, a hexagonal cross-section on the inside surface, or an octagonal cross-section on the inside surface. The solid matter outlet can also include geometric arrangement of plane faces for installing plane wear protection elements.

5 Claims, 2 Drawing Sheets

SCREENING MACHINE

Figure 1:
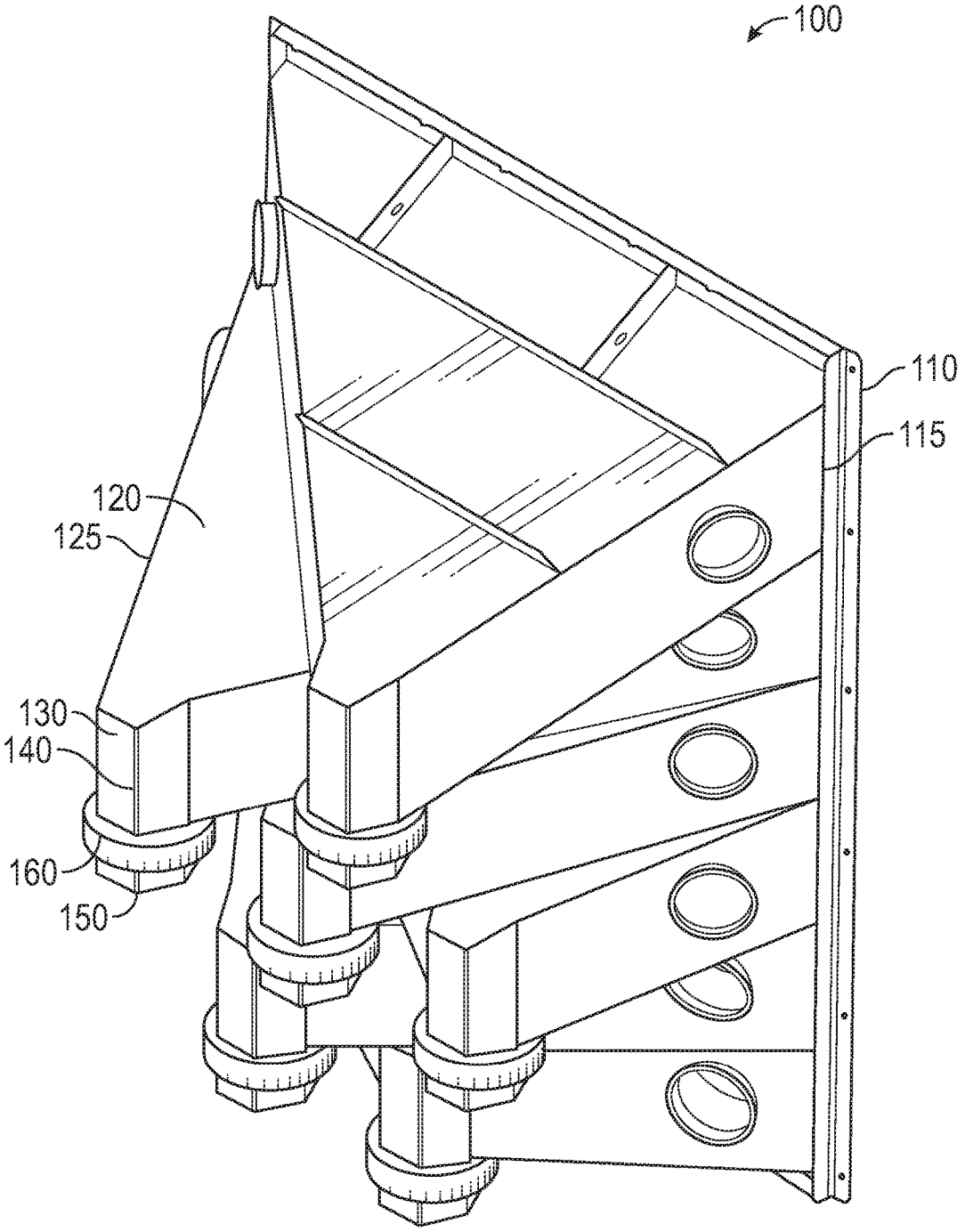

The subject matter of the instant invention is a screening machine comprising at least two solid matter outlets.

From prior art, screening machines comprising solid matter outlets with a circular or round cross-section are known. Such design appears mandatory if flexible hose elements are to be connected for connecting subsequent equipment or tubing to the solid matter outlet. Hose elements or tubing can only be connected reliably with a solid matter outlet via a round flange or collar. Other forms of connection, e.g. rectangular or polygonal cross-sections, have substantial disadvantages with respect to the mechanical properties such as precise connection fit, easy fixing of the connection, mechanical stability, and dust proofness.

On the other hand, the solid matter outlet of screening machines exhibits, depending on the mechanical property of the screened particles, especially the screen particle hardness and the mass of the screened particles, substantial wear. Since the solid matter stream of the screened particles is, after passing the discharge edge of the screening machine, on its way to the solid matter outlet, constricted in a collecting shaft, the particle speed and hence the impulse and the kinetic energy of the solid matter particles increase strongly. The particle stream then hits the inner walls of a downward-bent solid matter outlet at high speed and with a change of impulse, with the inner walls being subject to correspondingly high wear due to the impacting solid matter stream.

Therefore, it would be desirable to be able to install additional wear protection elements on the inside of the solid matter outlet, which are not only advantageous, but also necessary for some screening products. Especially in the case of mineral screening products only ceramic or mineral plates come into consideration due to the hardness requirements. Due to the shape of the solid matter outlets which have a circular cross-section in the state of the art, these wear protection elements can only be provided in the form of a tube. Since tubes can preferably only be exchanged as one-piece tube elements and the manufacturing of tubes or tube segments is very complex and cost-intensive, especially when they consist of hard metal or ceramics, the use of circular wear protection elements is of disadvantage.

It is therefore an object of the invention to provide a solid matter outlet for screening machines with a round connection device, wherein cost-efficient and mass-producible wear protection elements are used.

This object is solved by the screening machine with the features according to claim 1.

The screening machine in accordance with the invention comprises at least one solid matter outlet with a circular or round connection device, said solid matter outlet having a polygonal cross-section at least on the inside thereof. By means of this solution, which is technically simple and surprising alike, a solid matter outlet having a round connection device, but at the same time plane wear protection plates which are installable on the inside, is provided, said solid matter outlet overcoming the drawbacks of the state of the art and thus resulting in a substantially improved wear protection of a solid matter outlet of screening machines.

Advantageously, at least one solid matter outlet comprises a hexagonal cross-section at least on the inside. An advantage of this embodiment is a higher solid matter throughput as compared to a rectangular cross-section.

Advantageously, at least one solid matter outlet comprises an octagonal cross-section on the inside. An advantage of this embodiment is an even higher solid matter throughput as compared to a rectangular and to a hexagonal cross-section.

Expediently, at least one solid matter outlet comprises at least on the inside a geometric arrangement of plane faces on which plane wear protection elements can be installed. An advantage of this embodiment is that plane wear protection elements can be installed on the inside of a solid matter outlet without additional shaped elements.

The use of plane wear protection elements renders it possible to cut fitting shapes from a plane starting material, for instance, ceramics, hard metal, or mineral substances, and to seamlessly coat the solid matter outlets therewith. If different wear regions are subject to higher wear, it is possible in accordance with the invention to coat plane adjacent regions with appropriate wear protection plates and to exchange them selectively at different times, where necessary, without exchanging all the other wear protection elements which have not yet been worn sufficiently.

Figure 2:
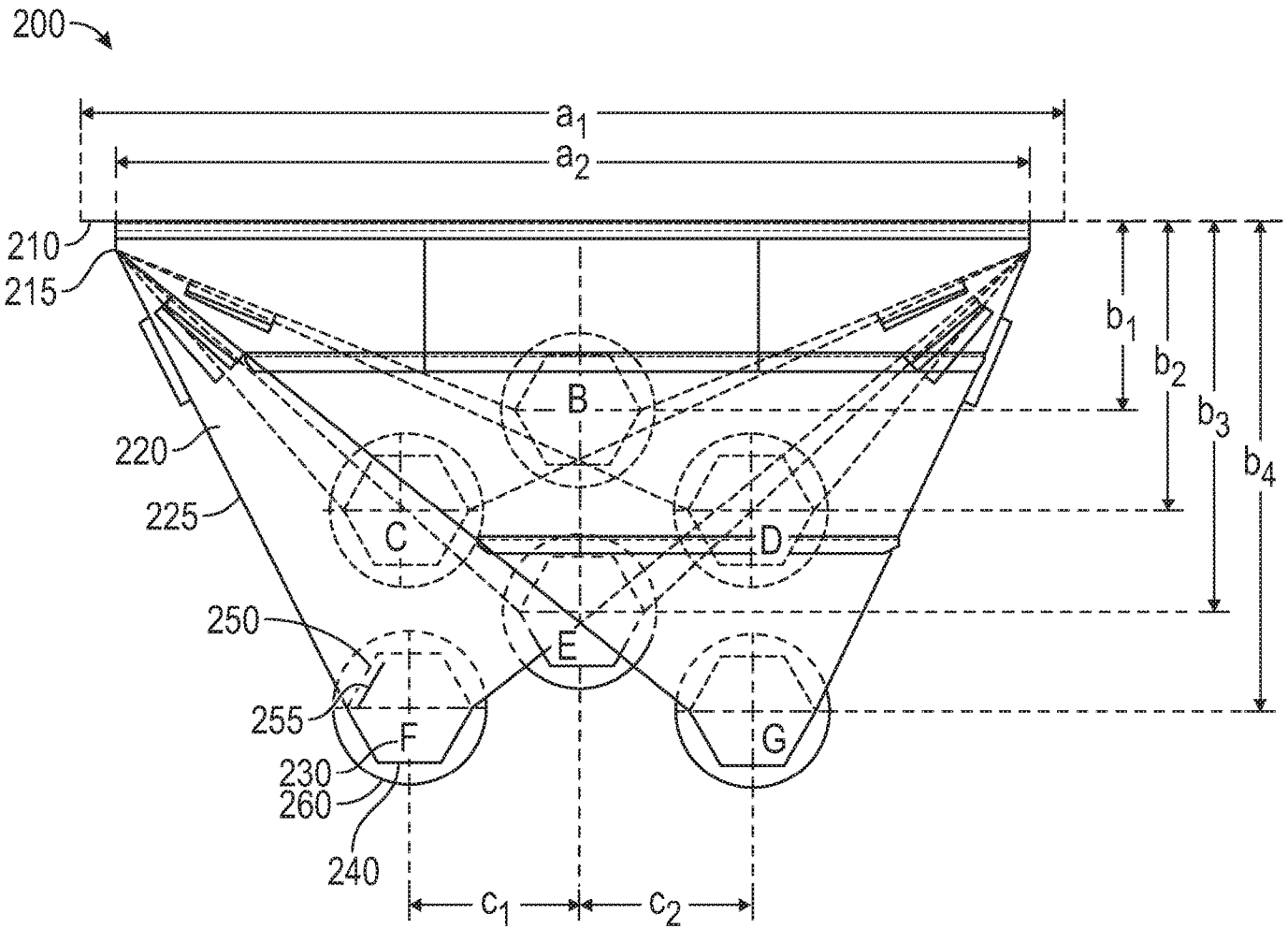

There show:

FIG. 1 a schematic oblique view of the solid matter outlets of a screening machine;

FIG. 2 a schematic top view of the solid matter outlets of a screening machine.

FIG. 1 illustrates a schematic oblique view of an assembly 100 of a screening machine with six screening decks (not illustrated in the picture) disposed in the screening housing with collecting shafts 125 tapering diagonally downward with their covers 120 and solid matter outlets 130. The screened solid matter stream flows from the collecting shafts 125 into the vertically downward kinking solid matter outlets 130. The solid matter outlets 130 comprise in the illustrated embodiment a hexagonal cross-section 140 with plane inner faces 150 and a circular and/or round connection device 160.

Hose elements or tubing which are not illustrated here can reliably be connected with the round connection device 160. Plane wear protection elements and/or wear protection plates can be installed at the plane inner faces 150. The assembly 100 is mountable by means of an assembly frame 110, 115 at a chassis and/or housing (not illustrated) of the screening machine.

FIG. 2 illustrates a schematic top view of an assembly 200 of a screening machine, which comprises six collecting shafts 225 tapering diagonally downward and narrowing in the top view. The collecting shafts 225 open in vertical solid matter outlets 230 designated with the letters B-G. The vertical solid matter outlets 230 with the letters B-G are arranged for constructional reasons in a horizontal grid with the distances $c_1$, $c_2$, and $b_1$-$b_4$. In the illustrated embodiment the solid matter outlets 230 have a hexagonal cross-section 240 with plane inner faces 250 and a circular and/or round connection device 260. Hose elements or tubing which are not illustrated here can be connected reliably with the round connection device 260.

Plane wear protection elements and/or wear protection plates 255 can be installed at the plane inner faces 250. In the schematic illustration only one wear protection plate 255 is shown by way of example. Expediently, all inner faces 250 or at least those inner faces 250 which are predominantly hit by the solid matter stream are provided with wear protection plates 255.

It is an advantage of the invention that plane wear protection plates 255 of ceramic, mineral, or hard-metallic material can be used and can be installed at the plane inner faces 250 without additional complex shaped parts, for instance, by gluing or screwing. Advantageously a releasable connection technique is chosen, so that the wear protection plates 255 are exchangeable. The assembly 200 can be mounted at a chassis and/or housing (not illustrated) of the screening machine by means of an assembly frame 210, 215 with the dimensions $a_1$, $a_2$.

The invention claimed is:

1. A screening machine comprising at least one solid matter outlet with at least one of a circular or round connection device, wherein the at least one solid matter outlet comprises at least one solid matter outlet having a polygonal cross-section at least on an inside surface of the solid matter outlet.

2. The screening machine according to claim 1, wherein the at least one solid matter outlet comprises at least one solid matter outlet having a hexagonal cross-section on at least on an inside surface.

3. The screening machine according to claim 2 further comprising a geometric arrangement of plane faces for installing plane wear protection elements.

4. The screening machine according to claim 1, wherein the at least one solid matter outlet comprises at least one solid matter outlet having an octagonal cross-section at least on an inside surface.

5. The screening machine according to claim 4 further comprising a geometric arrangement of plane faces for installing plane wear protection elements.

* * * * *